US010837273B2

(12) United States Patent
Moss et al.

(10) Patent No.: US 10,837,273 B2
(45) Date of Patent: Nov. 17, 2020

(54) SURFACE COIL FOR WELLBORE POSITIONING

(71) Applicant: Scientific Drilling International, Inc., Houston, TX (US)

(72) Inventors: Clinton Moss, Edmonton (CA); Douglas Ridgway, Edmonton (CA); Troy Martin, Edmonton (CA)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 101 days.

(21) Appl. No.: 15/573,773

(22) PCT Filed: May 14, 2016

(86) PCT No.: PCT/US2016/032577
§ 371 (c)(1),
(2) Date: Nov. 13, 2017

(87) PCT Pub. No.: WO2016/183536
PCT Pub. Date: Nov. 17, 2016

(65) Prior Publication Data

US 2018/0142547 A1 May 24, 2018

Related U.S. Application Data

(60) Provisional application No. 62/161,733, filed on May 14, 2015.

(51) Int. Cl.
*E21B 47/0228* (2012.01)
*E21B 47/0232* (2012.01)
(Continued)

(52) U.S. Cl.
CPC ..... *E21B 47/0228* (2020.05); *E21B 47/024* (2013.01); *E21B 47/026* (2013.01); *E21B 47/0232* (2020.05); *E21B 17/028* (2013.01)

(58) Field of Classification Search
CPC ..... E21B 47/02216; E21B 47/026; E21B 47/024; E21B 47/02224; E21B 47/022;
(Continued)

(56) References Cited

U.S. PATENT DOCUMENTS 4,072,200 A 2/1978 Morris et al.
4,502,010 A * 2/1985 Kuckes ..... G01V 3/26 324/247

(Continued)

FOREIGN PATENT DOCUMENTS

RU 2175368 C2 10/2001
WO 2014105087 A1 7/2014
WO 2014089490 A9 2/2015

OTHER PUBLICATIONS

International Search Report and Written Opinion issued in International Application No. PCT/US2016/032577, dated Aug. 17, 2016 (9 pages).

(Continued)

*Primary Examiner* — George S Gray
(74) *Attorney, Agent, or Firm* — Adolph Locklar

(57) ABSTRACT

A system includes a surface coil positioned at a known surface position, the surface coil including at least one loop of a conductor. The system also includes a coil controller coupled to the surface coil and adapted to inject a current into the surface coil such that the surface coil generates an electromagnetic field. In addition, the system includes a sensor package positioned within a wellbore adapted to detect the electromagnetic field and determine the position of the wellbore relative to the surface coil.

20 Claims, 3 Drawing Sheets

(51) Int. Cl.
*E21B 47/024* (2006.01)
*E21B 47/026* (2006.01)
*E21B 17/02* (2006.01)

(58) Field of Classification Search
CPC . E21B 47/09; E21B 7/04; E21B 7/046; E21B 17/028; E21B 47/0228; E21B 47/0232; E21B 17/0283; E21B 17/0285; G01B 7/00; G01B 7/003; G01S 13/878; G01S 13/885; G01V 3/26; G01L 37/00; G01L 37/003
See application file for complete search history.

(56) References Cited

U.S. PATENT DOCUMENTS 4,700,142 A 10/1987 Kuckes
4,791,373 A 12/1988 Kuckes
5,218,301 A * 6/1993 Kuckes ..... E21B 47/02 324/207.26
5,343,152 A * 8/1994 Kuckes ..... E21B 47/02216 175/45
6,260,656 B1 * 7/2001 Orban ..... G01V 1/003 181/112
6,466,020 B2 10/2002 Kuckes et al.
7,703,548 B2 4/2010 Clark
7,733,077 B1 6/2010 Merewether et al.
9,151,150 B2 10/2015 Fang et al.
2007/0240903 A1 10/2007 Alft et al.
2011/0006773 A1 * 1/2011 Bittar ..... E21B 47/02216 324/333

OTHER PUBLICATIONS

Office Action issued in Russian App. No. 2017143560, dated Jul. 2, 2019 and English translation thereof (14 pages).
Office Action issued in Russian App. No. 2017143560, dated Oct. 15, 2019 and English translation thereof (9 pages).

* cited by examiner

SURFACE COIL FOR WELLBORE POSITIONING

This application is a non-provisional application that claims priority from U.S. provisional application No. 62/161,733, filed May 14, 2015, which is incorporated by reference in its entirety.

TECHNICAL FIELD/FIELD OF THE DISCLOSURE

The present disclosure relates generally to positioning of a wellbore and specifically to the positioning of a wellbore using electromagnetic fields.

BACKGROUND OF THE DISCLOSURE

In many operations involving a wellbore, it is desirable to determine the position of a wellbore. For example, when drilling a directional wellbore, knowledge of the position and depth of the drill bit may be useful when, for example, drilling parallel wells or for avoiding existing wells. As a further example, during a hydraulic fracturing, acid washing, or steam-assisted gravity drainage (SAGD) operation, knowledge of the relative position of two parallel wellbores may be useful to assist in realizing the desired effects of the operation. Likewise, if a generally vertical observation well is used to monitor an operation, contact with the observation well may result in significant adverse consequences to the operation.

Typically, wellbore positioning is determined using a measurement while drilling (MWD) system. A MWD system may include sensors, including one or more accelerometers adapted to measure the Earth's gravity field, magnetometers to measure the Earth's magnetic field, and gyroscopes. A surveyed location may be calculated from the sensor measurements. However, the estimated position calculated from the data measurements from these sensors may drift as a well is drilled, especially for extended horizontal wells, which may cause the actual position of the well to be incorrectly determined.

SUMMARY

The present disclosure provides for a system. The system includes a surface coil positioned at a known surface position, the surface coil including at least one loop of a conductor. The system also includes a coil controller coupled to the surface coil and adapted to inject a current into the surface coil such that the surface coil generates an electromagnetic field. In addition, the system includes a sensor package positioned within a wellbore adapted to detect the electromagnetic field and determine the position of the wellbore relative to the surface coil.

The present disclosure further provides for a method for determining the location of a wellbore relative to a known surface position. The method includes positioning a surface coil, the surface coil positioned at a known distance and direction to the known surface position, the surface coil including at least one loop of a conductor. The method also includes drilling a wellbore with a drill string, the drill string including a sensor package. In addition, the method includes injecting a current through the surface coil such that the coil generates an electromagnetic field and measuring the electromagnetic field with the sensor package. The method includes calculating the position of the wellbore using at least the electromagnetic field.

The present disclosure also provides for a method for determining the location of a wellbore relative to a known position. The method may include positioning a surface coil at a location generally corresponding to the known position. The surface coil may include at least one loop of a conductor. The method may also include drilling a wellbore with a drill string. The drill string may include a magnetometer package. The method may also include injecting a current through the surface coil such that the coil generates an electromagnetic field. The method may also include measuring the electromagnetic field with the magnetometer package. The method may also include calculating the position of the wellbore using the electromagnetic field measurement.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
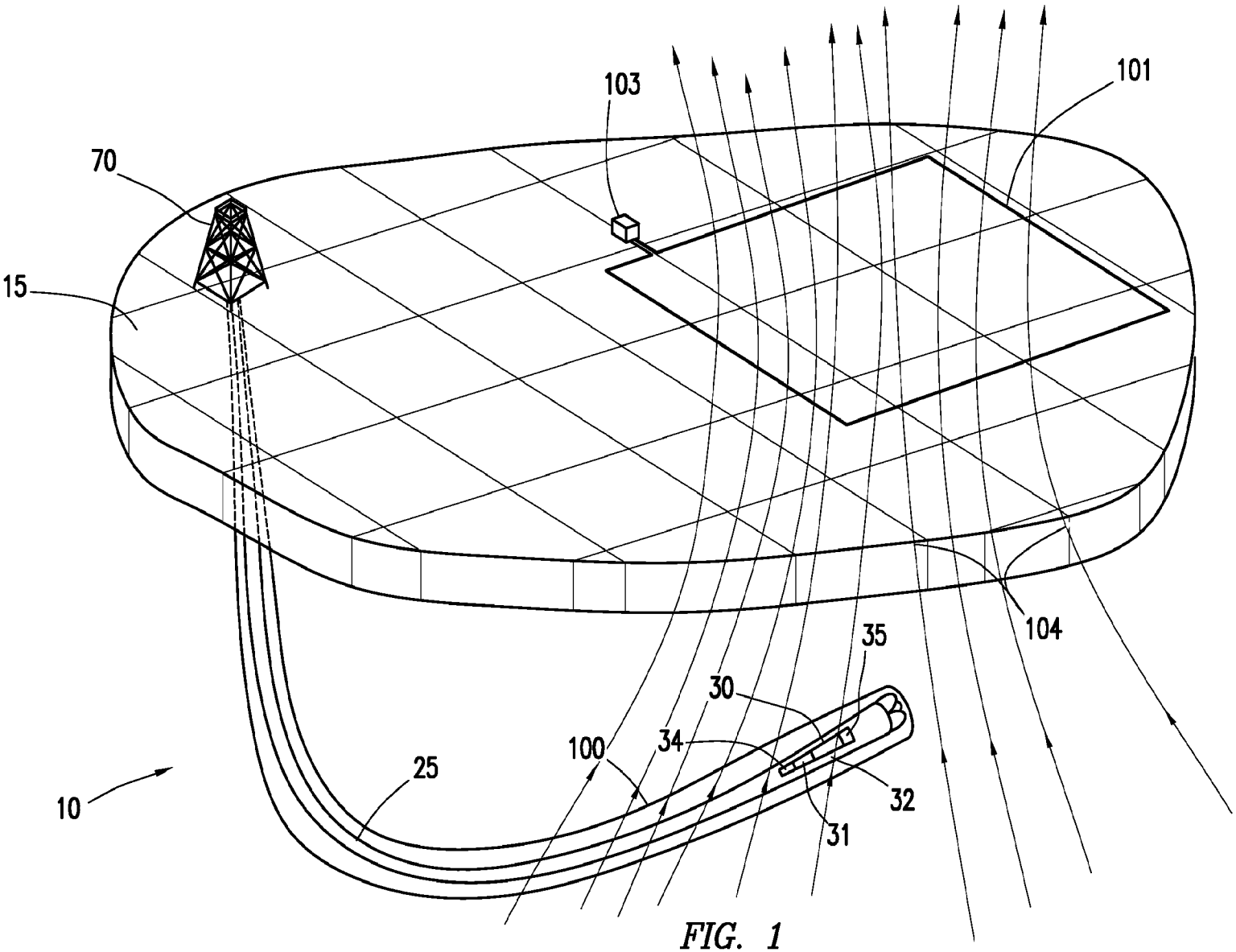
FIG. 1 depicts a representation of a horizontal drilling operation utilizing a surface coil consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

As depicted in FIG. 1, during a drilling operation, a wellbore 100 may be drilled through subsurface formation 10 from surface 15. Wellbore 100 may be drilled by derrick 20 using drill string 25. In some embodiments, drill string 25 may include sensor package 32. In certain embodiments, sensor package 32 may include magnetometer package 30. In other embodiments, sensor package 32 may include, in addition to magnetometer package 30, accelerometer package 31, gyroscope package 35, or a combination of accelerometer package 31 and gyroscope package 35. Magnetometer package 30 may include one or more magnetometers to detect and measure a magnetic field. Accelerometer package 31 may include one or more accelerometers to measure the Earth's gravity field. Gyroscope package 35 may include one or more gyroscopes. In some embodiments, sensor package 32 may be part of a MWD system. Sensor package 32 may be in electrical communication with processor 34. In the embodiment shown in FIG. 1, processor 34 is a downhole processor, although as one of ordinary skill in the art with the benefit of this disclosure will realize, processor 34 may be located at or near surface 15.

Figure 2:
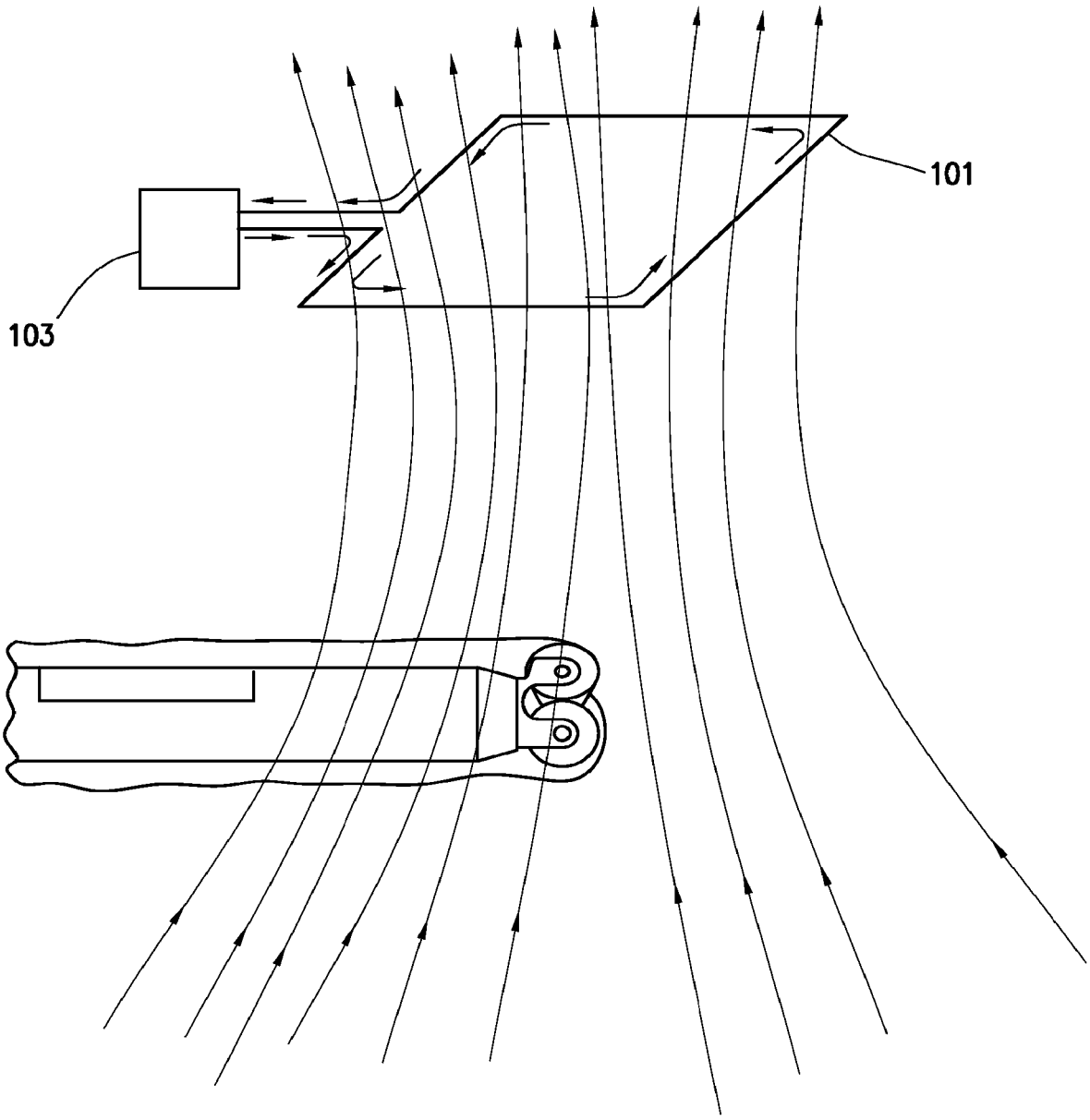
FIG. 2 depicts a schematic representation of a surface coil and magnetometer consistent with at least one embodiment of the present disclosure.

In some embodiments, surface coil 101 may be positioned on surface 15. Surface coil 101 may include one or more turns of an electrical conductor. As depicted in FIGS. 1, 2, surface coil 101 may be powered by coil controller 103. Coil controller 103 may supply electrical current to surface coil 101 such that surface coil 101 induces an electromagnetic field into the subsurface formation 10 as shown by lines 104. In some embodiments, coil controller 103 may supply alternating current (AC) power to surface coil 101. In some embodiments, coil controller 103 may supply direct current (DC) power to surface coil 101. In some such embodiments, the DC power supplied to surface coil 101 may be pulsed or alternated in polarity to generate the electromagnetic field.

In some embodiments, magnetometer package 30 may detect the electromagnetic field generated by surface coil 101. By analyzing the electromagnetic field detected by magnetometer package 30, such as in processor 34, the position of sensor package 32 and thus drill string 25 in wellbore 100 relative to surface coil 101 may be determined. In some embodiments, a measurement of the earth's gravity field from the accelerometers of accelerometer package 31 may be used in combination with a measurement of the electromagnetic field detected by magnetometer package 30, such as with processor 34, to determine the position of sensor package 32 and thus drill string 25 in wellbore 100 relative to surface coil 101. In some embodiments, a calculated magnetic field generated by surface coil 101 may be supplied to or generated by processor 34. By comparing measurements of sensor package 32 with the calculated magnetic field generated by the surface coil, the position of sensor package 32 relative to the surface coil may be determined. In certain embodiments, the position of sensor package 32 relative to the surface coil may be determined from sensor measurements from a single wellbore position.

In certain embodiments, the determination of the position of sensor package 32 relative to surface coil 101 may be performed during the drilling process. In other embodiments, the determination of the position of sensor package 32 relative to surface coil 101 may be performed after total depth is reached or after completion of drilling. For instance, after total depth is reached or after completion of drilling, when sensor package 32 is part of a MWD system as the MWD system is removed from wellbore 100, measurements may be taken with sensor package 32. In another embodiment, after reaching total depth and with using drill string 25 within wellbore 100, sensor package 32 could be pumped or allowed to fall via gravity in the internal diameter of a wellbore tubular. In such an embodiment, measurements taken by sensor package 32 may be recorded and determination of the position of sensor package 32 relative to surface coil 101 upon retrieval of sensor package 32. In yet other embodiments, after achieving total depth, drill string 25 may be withdrawn from wellbore 100. Sensor package 32 may be lowered via a wireline and/or a wellbore tractor. Sensor package 32 may then take measurements along wellbore 100 and determine distance and/or direction to surface coil 101. In still yet other embodiments, after achieving total depth, casing or liner may be positioned within wellbore 100. Sensor package 32 may then be deployed within wellbore 100, such as by pumping the sensor package 32 down the casing with a connected wireline, pumping the sensor without a wireline and recording the measurements of sensor package 32, deploying sensor package 32 using a wireline tractor within the casing, deploying sensor package 32 via coiled tubing within wellbore 100 using an E-line within the coiled tubing, or deploying sensor package 32 in a cased well with a tubing string using a workover rig. In other embodiments, after drilling has been completed, wellbore 100 may be cased with, for example, traditional ferromagnetic casing, such as steel, fiber glass, or a non-magnetic casing. Sensor package 32 may then be deployed in the cased wellbore. In other embodiments, a portion of wellbore 100 may be left open, i.e, uncased, such as the bottom portion of wellbore 100. Sensor package 32 may be deployed into the uncased section of wellbore 100 out of, for instance, a guide shoe. Sensor package 32 may then perform measurements in the uncased section of wellbore 100.

In some embodiments, the position of surface coil 101 may be laid out utilizing a global navigation satellite system (GNSS) such as GPS, GLONASS, BeiDou, IRNSS, or Galileo. In some such embodiments, surface coil 101 may be positioned by laying out the conductor according to directions given to the positioner in terms of a path driven by latitude and longitudinal waypoints as determined by a GNSS receiver.

In some embodiments, as depicted in FIG. 1, surface coil 101 may be in the shape of a square. In other embodiments, as understood in the art, surface coil 101 may be laid out in other configurations, including, for example and without limitation, rectangular, circular, ellipsoidal, polygonal, etc. One having ordinary skill in the art with the benefit of this disclosure will understand that the arrangement of surface coil 101 may be any shape as long as the electromagnetic field produced thereby is capable of producing a sufficient electromagnetic field tailored to allow positional determination in wellbore 100. In certain embodiments, the shape and size of the surface coil 101 may be determined by the anticipated path of wellbore 100. In some embodiments, the polarity, waveform, and magnitude of the current passed through surface coil 101 by coil controller 103 may be determined based at least in part on the anticipated depth of wellbore 100. In some embodiments, coil controller 103 may pass current continuously through surface coil 101. In some embodiments, coil controller 103 may pass current through surface coil 101 only when a measurement with respect to surface coil 101 is desired to be made.

In some embodiments, surface coil 101 may be positioned to correspond with a surface or subterranean feature. For example, in some embodiments, as shown in FIG. 1, surface coil 101 may be positioned at a known surface location. In some embodiments, the known surface location may be determined relative to a feature. The feature may be a surface feature, including, but not limited to, a survey marker, a property line, a lease line, the surface portion of a well, such as an observation well or generally horizontal well (as described hereinbelow), or any other surface feature of interest. As an example, where the surface feature is the surface portion of a vertical well, surface coil 101 may be located near or around the vertical well. In certain embodiments, the surface location is determined relative to a subterranean feature or calculated subterranean location. For instance, in certain embodiments, the location of a subterranean obstacle may be known. Examples of a subterranean obstacle include, but are not limited to, a salt dome, cased wellbore, or formation containing water. The known surface location may be determined relative to the subterranean obstacle. In other embodiments, a calculated subterranean location, such as a point along an anticipated well path, may be created. The known surface location may be determined relative to the calculated subterranean location. In certain embodiments, the known surface location may be positioned at a predetermined distance and/or direction from the surface feature, subterranean feature, or calculated subterranean location.

Figure 3:
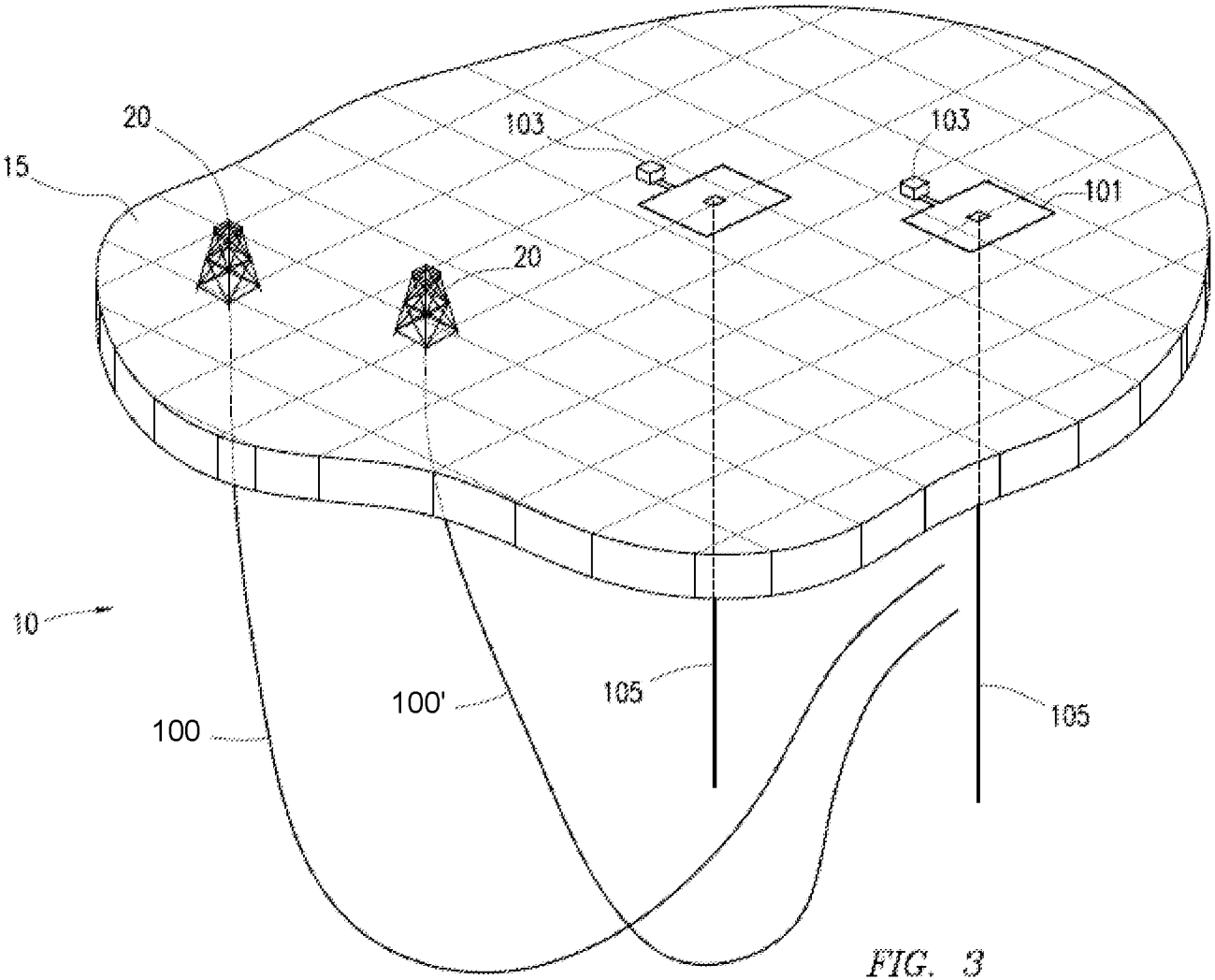
FIG. 3 depicts a representation of a SAGD operation utilizing a surface coil consistent with at least one embodiment of the present disclosure.

In some embodiments, as depicted in FIG. 3, the feature may include, for example and without limitation, another wellbore such as observation well 105 or a generally horizontal well. In some embodiments, observation well 105 may be generally vertical. Observation well 105 may include one or more sensors adapted to measure parameters of surrounding formation 10. By positioning wellbore 100 around or near to observation well 105, the measurement data from observation well 105 may be more useful. For example, during a SAGD operation, observation well 105 may include sensors adapted to measure temperature and pressure in surrounding formation 10. In such an embodiment, if observation well 105 is intercepted by wellbore 100, steam injected thereby may flow through observation well 105, limiting or eliminating the effectiveness of the SAGD operation. In some embodiments in which multiple observation wells 105 are utilized, each observation well 105 may include a separate surface coil 101. In some embodiments, surface coils 101 may be operated such that they are not actuated simultaneously, allowing sensor package 32 to determine the position of wellbore relative to each observation well 105.

Furthermore, if a second wellbore 100' is drilled into surrounding formation 10, as depicted in FIG. 3, knowledge of the location of wellbore 100 as well as ongoing knowledge of the location of second wellbore 100' may allow for spacing between wellbores 100, 100' to be known and maintained at a selected distance, direction, or well path. For example, during a SAGD operation, if wellbores 100, 100' are spaced too close together, steam injected into, for example, wellbore 100 may flow through surrounding formation 10 and out second wellbore 100'. Likewise, if spaced too far apart, insufficient heating may reach second wellbore 100', limiting the effectiveness of the SAGD operation. Similarly, in a hydraulic fracturing operation, if wellbores 100, 100' are spaced too close together, fractures formed in surrounding formation 10 may reach from wellbore 100 to second wellbore 100', reducing the effectiveness of the hydraulic fracturing operation. Likewise, if spaced too far apart, the hydraulic fracturing zones may not reach each other or sufficiently overlap, again reducing the effectiveness of the hydraulic fracturing operation.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A system comprising:

a surface coil positioned at a known surface position, the surface coil including at least one loop of a conductor;

a coil controller coupled to the surface coil and adapted to inject a current into the surface coil such that the surface coil generates an electromagnetic field; and a sensor package positioned within a wellbore adapted to detect the electromagnetic field and determine the position of the wellbore relative to the surface coil, wherein the surface coil is positioned around a known surface position and the known surface position is spaced apart from the surface location of the wellbore, and further wherein the known surface position is determined relative to a surface feature, wherein the surface feature is a survey marker, a property line, or a lease line.

2. The system of claim 1, wherein the sensor package comprises one or more magnetometers.

3. The system of claim 1, wherein the sensor package further comprises one or more accelerometers, one or more gyroscopes, or a combination thereof.

4. The system of claim 1, wherein the known surface position is determined relative to a subterranean feature or calculated subterranean feature.

5. The system of claim 1, wherein the coil controller provides an AC current to the surface coil, a DC current to the surface coil, or a combination thereof.

6. A method for determining the location of a wellbore relative to a known surface position, the known surface position being distinct from the surface location of the wellbore, the method comprising:

positioning a surface coil, the surface coil positioned at a known distance and direction to the known surface position, the surface coil including at least one loop of a conductor, the surface coil positioned around a known surface position and spaced apart from the wellbore at the surface;

drilling the wellbore with a drill string, the drill string including a sensor package;

injecting a current through the surface coil such that the coil generates an electromagnetic field;

measuring the electromagnetic field with the sensor package; and calculating the position of the wellbore using at least the electromagnetic field, wherein the known surface position is determined relative to a surface feature, and further wherein the surface feature is a survey marker, a property line, or a lease line.

7. The method of claim 6, further comprising calculating the distance between the wellbore and a second wellbore, the second wellbore being a generally vertical observation well positioned at the known position or a horizontal wellbore.

8. The method of claim 7, further comprising steering the drill string such that the wellbore maintains a selected distance, direction, or wellpath, from the second wellbore.

9. The method of claim 6, further comprising determining the known surface position relative to a surface feature or a subterranean feature.

10. The method of claim 6 further comprising measuring the Earth's gravity field with the sensor package.

11. The method of claim 10, wherein the step of calculating the position of the wellbore further includes using the Earth's gravity field.

12. The method of claim 6, wherein the sensor package is part of an MWD system.

13. The method of claim 6, wherein the step of positioning a surface coil further comprises laying out the surface coil.

14. The method of claim 13, wherein the step of laying out the surface coil includes utilizing a global navigation satellite system.

15. The method of claim 6, wherein the surface coil is in the shape of a square, rectangle, ellipsoid, or polygon.

16. The method of claim 6, wherein the shape of the surface coil is determined by an anticipated path of the wellbore.

17. The method of claim 6, wherein the current has a polarity, waveform, and magnitude, and wherein at least one of the polarity, waveform or magnitude is determined by an anticipated depth of the wellbore.

18. The method of claim 6, wherein the step of injecting a current through the surface coil is performed by a coil controller.

19. The method of claim 18, wherein the current is injected continuously through the surface coil.

20. The method of claim 18, wherein the current is injected through the surface coil when measuring the electromagnetic field with the sensor package.

* * * * *